US009874204B2

(12) United States Patent
Tabei et al.

(10) Patent No.: US 9,874,204 B2
(45) Date of Patent: Jan. 23, 2018

(54) SWASH PLATE COMPRESSOR

(71) Applicant: SANDEN CORPORATION, Isesaki-shi (JP)

(72) Inventors: Toshiharu Tabei, Isesaki (JP); Tetsuya Morijiri, Isesaki (JP); Hideaki Sato, Isesaki (JP); Takeo Yasu, Isesaki (JP)

(73) Assignee: SANDEN CORPORATION, Gunma (JP)

( * ) Notice: Subject to any disclaimer, the term of this patent is extended or adjusted under 35 U.S.C. 154(b) by 397 days.

(21) Appl. No.: 14/420,281

(22) PCT Filed: Aug. 8, 2013

(86) PCT No.: PCT/JP2013/071564

§ 371 (c)(1),
(2) Date: Feb. 6, 2015

(87) PCT Pub. No.: WO2014/024996

PCT Pub. Date: Feb. 13, 2014

(65) Prior Publication Data

US 2015/0285232 A1 Oct. 8, 2015

(30) Foreign Application Priority Data

Aug. 9, 2012 (JP) ..... 2012-176754

(51) Int. Cl.
*F04B 27/08* (2006.01)

(52) U.S. Cl.
CPC ..... *F04B 27/086* (2013.01); *F04B 27/0886* (2013.01)

(58) Field of Classification Search
CPC ..... F04B 27/086; F04B 27/0886
USPC ..... 92/13, 71
See application file for complete search history.

(56) References Cited

U.S. PATENT DOCUMENTS 5,943,941 A * 8/1999 Kato ..... F04B 27/0886 417/222.1
6,308,615 B1 * 10/2001 Takenaka ..... F04B 27/0878 384/2
8,877,031 B2 * 11/2014 Suda ..... C25D 11/04 205/109

FOREIGN PATENT DOCUMENTS

| | | |
|---|---|---|
| JP | 08-247026 | 9/1996 |
| JP | 2000-178695 | 6/2000 |
| JP | 2003-245485 | 9/2003 |
| JP | 2011-032883 | 2/2011 |

* cited by examiner

*Primary Examiner* — Thomas E Lazo
(74) *Attorney, Agent, or Firm* — Cozen O'Connor

(57) ABSTRACT

A swash plate compressor 100 includes a swash plate 111 that rotates with a drive shaft 110, a pair of shoes 137*a* and 137*b* placed to sandwich a portion of the swash plate 111 close to a periphery of the swash plate 111, and a piston 136 connected to the swash plate 111 via the pair of shoes 137*a* and 137*b*. The piston 136 reciprocates in a cylinder bore 101*a* as the swash plate 111 rotates due to the rotation of the drive shaft 110. In the swash plate compressor 100, a zinc phosphate film is formed on each portion of the piston 136 at which the corresponding shoe 137*a*, 137*b* is in sliding contact. This reduces occurrence of galling or seizing at the sliding contact portions between the piston 136 and the shoes 137*a* and 137*b*.

6 Claims, 5 Drawing Sheets

| | NUMBER OF TRIES | COMPLETION OF10 ROTATIONS |
|---|---|---|
| ROTATION NUMBER OF DRIVE SHAFT: 20 | n=5 | n=1 |
| ROTATION NUMBER OF DRIVE SHAFT: 80 | n=5 | n=5 |

SWASH PLATE COMPRESSOR

RELATED APPLICATIONS

This is a U.S. National Phase Application under 35 USC 371 of International Application PCT/JP2013/071564 filed on Aug. 8, 2013.

This application claims the priority of Japanese application no. 2012-176754 filed Aug. 9, 2012, the entire content of which is hereby incorporated by reference.

TECHNICAL FIELD

The present invention relates to a swash plate compressor in which a swash plate rotating with a drive shaft causes a piston to reciprocate, and more particularly, relates to a swash plate compressor for use in a refrigerant circulation device such as a vehicle air conditioning system.

BACKGROUND ART

Patent Document 1 discloses that, in a compressor in which rotation of a swash plate fixed to a drive shaft is converted into reciprocating motion of a piston via a shoe, a surface covering layer mainly of tin having self-lubricating properties is formed on a fitting part of the piston in sliding contact with the shoe. In the compressor disclosed in Patent Document 1, the effects of the surface covering layer mainly of tin can reduce frictional resistance between the piston and the shoe, and can prevent seizing at sliding portions between the piston and the shoe associated with the lack of lubrication.

REFERENCE DOCUMENT LIST

Patent Document

Patent Document 1: Japanese Patent Application Laid-open Publication No. H08-247026

SUMMARY OF THE INVENTION

Problems to be Solved by the Invention

Formation of a solid lubricant film such as the surface covering layer mainly of tin, however, is relatively costly. In compressors of this type, further cost reduction has been required, and a technique that prevents seizing at a sliding contact portion between the piston and the shoe has been desired.

Accordingly, the present invention aims to provide a swash plate compressor that achieves cost reduction while ensuring sufficient galling resistance and seizing resistance at the sliding contact portion between a piston and a shoe.

Means for Solving the Problems

A swash plate compressor according to an aspect of the present invention includes a swash plate that rotates with a drive shaft, a pair of shoes placed to sandwich a portion of the swash plate close to a periphery of the swash plate, and a piston connected to the swash plate via the pair of shoes, the piston being caused to reciprocate by rotation of the swash plate. In the swash plate compressor, a zinc phosphate film is formed on each portion of the piston at which each of the pair of shoes is in sliding contact.

Effects of the Invention

According to the swash plate compressor, since the zinc phosphate film is formed on each portion of the piston at which the corresponding shoe is in sliding contact, even if the sliding contact portions between the pair of shoes and the piston temporarily came into an unlubricated state, running-in ability of the zinc phosphate film can reduce occurrence of galling or seizing at the sliding contact portions. Also, the zinc phosphate film can be formed at lower costs than a solid lubricant film such as a surface covering layer mainly of tin, reducing costs of a swash plate compressor compared with a conventional one.

MODE FOR CARRYING OUT THE INVENTION

An embodiment of the present invention will be described with reference to the accompanying drawings.

Figure 1:
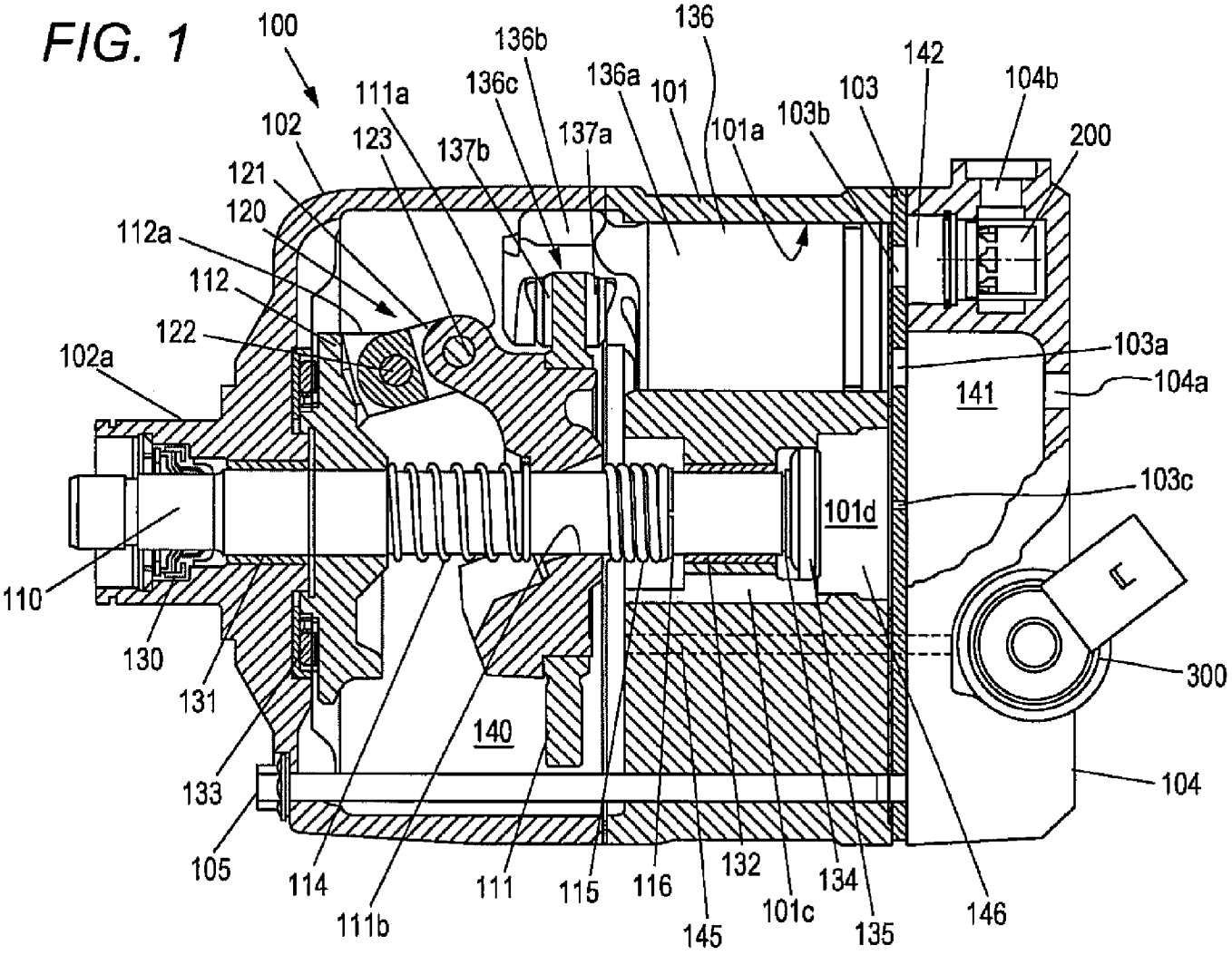
FIG. 1 is a cross sectional view of a variable displacement compressor (swash plate compressor) to which the present invention is applied.

FIG. 1 is a cross sectional view of a variable displacement compressor 100 that is an example of a swash plate compressor to which the present invention is applied. The variable displacement compressor 100 is for use in a refrigerant circulation device (not shown), to draw in, compress, and discharge refrigerant of the refrigerant circulation device. It is assumed that, in the present embodiment, the variable displacement compressor 100 is for use in a vehicle air conditioning system.

As illustrated in FIG. 1, the variable displacement compressor 100 is provided with a cylinder block 101 with a plurality of cylinder bores 101*a*, a front housing 102 provided at one end of the cylinder block 101, and a cylinder head 104 provided at the other end of the cylinder block 101 via a valve plate 103.

The cylinder block 101 together with the front housing 102 forms a crank chamber 140, and a drive shaft 110 is provided to traverse the inside of the crank chamber 140.

A swash plate 111 is placed in the crank chamber 140. The swash plate 111 has at the center thereof a through hole 111*b*, through which the drive shaft 110 is inserted.

The swash plate 111 is connected to a rotor 112 fixed to the drive shaft 110 via a link mechanism 120 serving as a connecting means. Accordingly, the swash plate 111 rotates with the drive shaft 110 and can change an angle of inclination (inclination angle) with respect to the drive shaft 110.

The link mechanism 120 includes a first arm 112*a* projecting from the rotor 112, a second arm 111*a* projecting from the swash plate 111, and a link arm 121 rotatably connected at one end to the first arm 112*a* via a first connecting pin 122 and rotatably connected at the other end to the second arm 111*a* via a second connecting pin 123.

The through hole 111*b* of the swash plate 111 is shaped to allow the swash plate 111 to incline from a maximum inclination angle to a minimum inclination angle. In the present embodiment, the through hole 111*b* has a minimum inclination angle regulating part that regulates displacement of inclination angle (inclination) of the swash plate 111 in the direction reducing the inclination angle by abutting on the drive shaft 110. For example, if an inclination angle of the swash plate 111 perpendicular to the drive shaft 110 is taken as 0 degrees (minimum inclination angle), the minimum inclination angle regulating part is formed to allow the displacement of the inclination angle (inclination) until the inclination angle of the swash plate 111 is substantially 0. The displacement of the inclination angle (inclination) of the swash plate 111 in the direction increasing the angle is regulated by the swash plate 111 abutting on the rotor 112. Thus, the inclination angle of the swash plate 111 is at the maximum inclination angle when the swash plate 111 abuts on the rotor 112.

An inclination angle reducing spring 114 biasing the swash plate 111 in the direction reducing the inclination angle and an inclination angle increasing spring 115 biasing the swash plate 111 in the direction increasing the inclination angle are mounted on the drive shaft 110 with the swash plate 111 positioned therebetween. Specifically, the inclination angle reducing spring 114 is mounted between the swash plate 111 and the rotor 112, and the inclination angle increasing spring 115 is mounted between the swash plate 111 and a spring supporting member 116 fixed to or formed on the drive shaft 110.

Here, the inclination angle increasing spring 115 is configured to have a larger biasing force than that of the inclination angle reducing spring 114 when the inclination angle of the swash plate 111 is at the minimum inclination angle. Accordingly, when the drive shaft 110 is not rotating, in other words, when the variable displacement compressor 100 is stopped, the swash plate 111 is positioned at an inclination angle at which the biasing forces of the inclination angle reducing spring 114 and the inclination angle increasing spring 115 are balanced (>minimum inclination angle). The inclination angle at which the biasing forces of the inclination angle reducing spring 114 and the inclination angle increasing spring 115 are balanced is configured to be a minimum possible inclination angle range ensuring the compressing operation of the piston 136, and may be, for example, from 1 to 3 degrees.

One end of the drive shaft 110 penetrates a boss 102*a* of the front housing 102 and extends to the outside of the housing 102 to be connected to a power transmission device (not shown). A shaft seal 130 is inserted between the drive shaft 110 and the boss 102*a*, so that the inside of the crank chamber 140 is cut off from the outer space.

The drive shaft 110 and the rotor 112 are supported by bearings 131 and 132 in a radial direction and by a bearing 133 and a thrust plate 134 in the thrust direction. An end of the drive shaft 110 closer to the thrust plate 134 and the thrust plate 134 are adjusted to have a predetermined clearance by an adjusting screw 135.

The drive shaft 110 rotates synchronously with the power transmission device as a power from an external drive source (not shown) is transmitted to the power transmission device.

The variable displacement compressor 100 has the pistons 136, the number of which is the same as that of the cylinder bores 101*a*. Each piston 136 is provided with a piston main body 136*a* and an extending part 136*b* extending from the piston main body 136*a*. The piston main body 136*a* is placed in the cylinder bore 101*a* and the extending part 136*b* projects to the crank chamber 140.

In the extending part 136*b* of the piston 136, an accommodating part 136*c* is formed. The accommodating part 136*c* accommodates therein a pair of shoes 137*a* and 137*b* that are placed to sandwich a portion of the swash plate 111, the portion being close to the periphery of the swash plate 111. That is, the piston 136 is connected to the swash plate 111 via the pair of shoes 137*a* and 137*b* that are placed so as to sandwich the portion of the swash plate 111 close to its periphery. Thus, the piston 136 (piston main body 136*a*) reciprocates in the corresponding cylinder bore 101*a* as the swash plate 111 rotates. The connection structure between the swash plate 111 and the piston 136 will be described below.

In the present embodiment, the piston 136 is formed of aluminum-based material, and the pair of shoes 137*a* and 137*b* are formed of iron-based material (such as bearing steel).

In the description below, among the pair of shoes 137*a* and 137*b* placed in the accommodating part 136*c*, the shoe 137*a* placed on the piston main body 136*a* side of the swash plate 111 is referred to as a "first shoe", and the shoe 137*b* placed on the opposite side of the swash plate 111, that is, opposite to the piston main body 136*a*, is referred to as a "second shoe".

In the cylinder head 104, an suction chamber 141 positioned at the center and a plurality of discharge chambers 142 positioned to annularly surround the suction chamber 141 are formed. The suction chamber 141 communicates with cylinder bores 101*a* via corresponding communication holes (suction hole) 103*a* formed on the valve plate 103 and corresponding suction valves (not shown). The discharge chamber 142 communicates with the corresponding cylinder bore 101*a* via a communication hole (discharge hole) 103*b* formed on the valve plate 103 and a discharge valve (not shown).

Here, the front housing 102, a center gasket (not shown), the cylinder block 101, a cylinder gasket (not shown), the valve plate 103, a head gasket (not shown), and the cylinder head 104 are fastened to each other with a plurality of through bolts 105 to form a compressor housing.

In the cylinder head 104, an suction passage 104*a* communicating a refrigerant circuit of the vehicle air conditioning system on the low pressure side with the suction chamber 141, and a discharge passage 104*b* communicating the refrigerant circuit on the high pressure side with the discharge chamber 142, are formed.

In the cylinder head 104, a check valve 200 as an opening and closing means that opens and closes the discharge passage 104*b* is placed. The check valve 200 operates in response to a difference between a pressure in the discharge chamber 142, which is upstream of the check valve 200, and a pressure in the discharge passage 104*b*, which is downstream of the check valve 200. The check valve 200 shuts off the discharge passage 104*b* when the pressure difference is below a predetermined value, and opens the discharge passage 104*b* when the pressure difference is above the predetermined value.

In the cylinder head 104, a control valve 300 is also provided. The control valve 300 adjusts the opening degree of a pressure supply passage 145 that communicates the discharge chamber 142 with the crank chamber 140, so as to control an amount of discharge gas to be introduced into the crank chamber 140. Refrigerant in the crank chamber 140 flows through a pressure relief passage 146 composed of a communication passage 101*c*, a space 101*d*, and an orifice 103*c* formed in the valve plate 103, and flows to the suction chamber 141.

Accordingly, the control valve 300 changes the pressure in the crank chamber 140, which in turn changes the inclination angle of the swash plate 111, that is, a stroke of the piston 136. As a result, a discharge capacity of the variable displacement compressor 100 can be varied.

Figure 2:
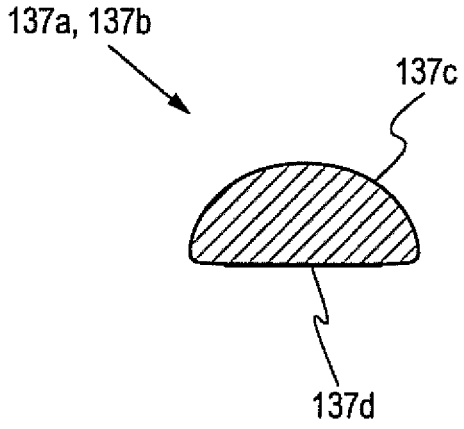
FIG. 2 is an enlarged cross sectional view of a shoe of the variable displacement compressor.
Figure 3:
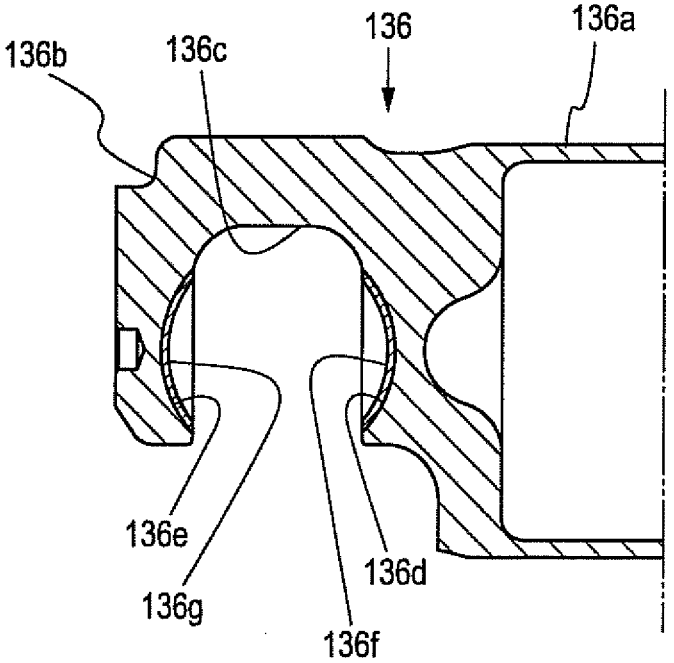
FIG. 3 is an enlarged view of the main part of a piston of the variable displacement compressor.
Figure 4:
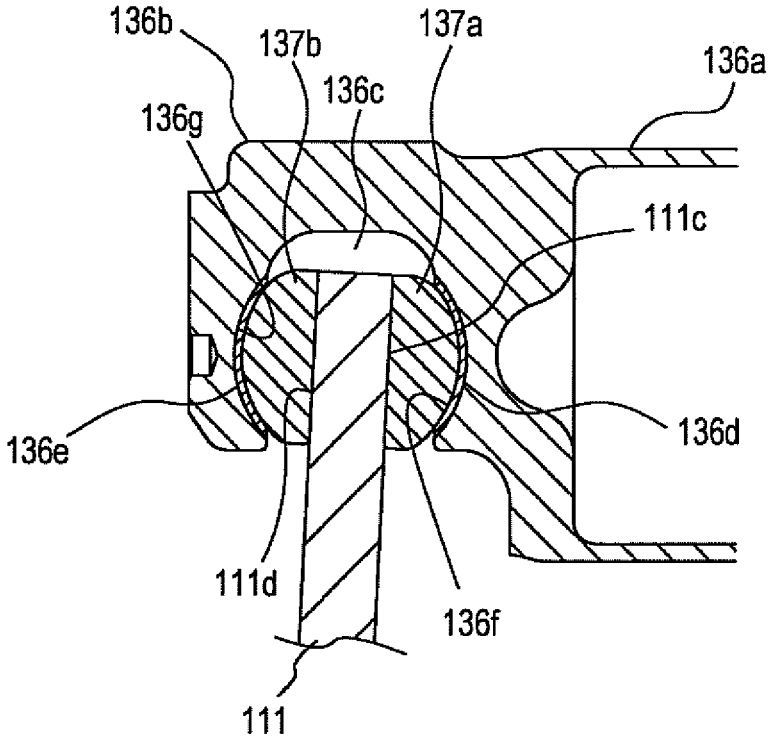
FIG. 4 is an enlarged view of a connection part between a swash plate and the piston of the variable displacement compressor.

Next, the connection structure between the swash plate 111 and the piston 136 in the variable displacement compressor 100 will be described in detail with reference to FIGS. 2 to 4. FIG. 2 is an enlarged cross sectional view of the first shoe 137*a* and the second shoe 137*b*. FIG. 3 is an enlarged view of the main part of the piston 136. FIG. 4 is an enlarged view of the connection part between the swash plate 111 and the piston 136.

The first shoe 137*a* and the second shoe 137*b* are formed in the same shape, each having a spherical part 137*c* and a flat part 137*d*.

In the piston 136, the piston main body 136*a* is formed hollow. An abrasion resistant film (such as PTFE coating layer, not shown) is formed on an outer peripheral surface of the piston main body 136*a* in sliding contact with the cylinder bore 101*a* and an outer surface of the extending part 136*b* in sliding contact with an inner peripheral surface of the front housing 102. In addition, a pair of concave spherical sliding parts (a first sliding part 136*d* and a second sliding part 136*e*) is formed in the accommodating part 136*c* formed in the extending part 136*b*. Zinc phosphate films 136*f* and 136*g* as running-in layers are formed on surfaces of the first sliding part 136*d* and the second sliding part 136*e*, respectively.

As described above, in the accommodating part 136*c* formed in the extending part 136*b* of the piston 136, the first shoe 137*a* is placed on the piston main body 136*a* side of the swash plate 111, and the second shoe 137*b* is placed on the opposite side of the swash plate 111, that is, opposite to the piston main body 136*a*.

The spherical part 137*c* of the first shoe 137*a* is in sliding contact with the zinc phosphate film 136*f* formed on the first sliding part 136*d*, and the flat part 137*d* of the first shoe 137*a* is in sliding contact with an annular flat sliding part 111*c* formed on a surface of the swash plate 111 closer to the piston main body 136*a*. The spherical part 137*c* of the second shoe 137*b* is in sliding contact with the zinc phosphate film 136*g* formed on the second sliding part 136*e*, and the flat part 137*d* of the second shoe 137*b* is in sliding contact with an annular flat sliding part 111*d* formed on a surface of the swash plate 111 opposite to the piston main body 136*a*.

No film is formed in particular on surfaces of the first shoe 137*a* and the second shoe 137*b*, and an abrasion resistant film (such as PTFE coating layer, not shown) is formed on surfaces of the flat sliding parts 111*c* and 111*d* of the swash plate 111.

With the connection structure (more specifically, sliding connection structure) between the swash plate 111 and the piston 136, the rotation of the swash plate 111 associated with the rotation of the drive shaft 110 is converted into reciprocating motion of the piston 136 in the cylinder bore 101*a* via the pair of shoes (the first shoe 137*a* and the second shoe 137*b*). As a result, the variable displacement compressor 100 draws in, compresses, and discharges refrigerant in the vehicle air conditioning system.

Next, the zinc phosphate films 136*f* and 136*g* in sliding contact with the spherical parts 137*c* of the shoes 137*a* and 137*b* will be described with reference to FIGS. 5 to 9.

Zinc phosphate (film) treatment is well known to be used as surface preparation, and can be applied to aluminum materials. The zinc phosphate films 136*f* and 136*g* are formed, for example, by immersing the extending part 136*b* of the piston 136 in a treatment liquid so as to cause a reaction between an aluminum base of the pair of concave spherical sliding parts (the first sliding part 136*d* and the second sliding part 136*e*) and the treatment liquid. As just described, the treatment process for forming the zinc phosphate film is relatively simple, thereby reducing the cost for forming the film compared with the case of forming a solid lubricant film such as the surface covering layer mainly of tin.

Here, in adopting the zinc phosphate films 136*f* and 136*g* as films to be formed on the first sliding part 136*d* and the second sliding part 136*e*, the inventors have confirmed the capabilities in the following tests.

(1) Test 1 (Abrasion Resistance of Zinc Phosphate Films 136*f* and 136*g*)

The zinc phosphate films 136*f* and 136*g* are crystalline films and their treatment conditions are controlled to achieve the crystal grains in predetermined conditions. The zinc phosphate films 136*f* and 136*g* formed under the treatment conditions each have a thickness of between 1 to 6 μm and a surface roughness Ra of 0.6 or less.

As operation time of the variable displacement compressor 100 increases, the abrasion of the zinc phosphate films 136*f* and 136*g* progresses. Here, during the operation of the variable displacement compressor 100, more load is applied to the zinc phosphate film 136*f* on the surface of the first sliding part 136*d* than on the zinc phosphate film 136*g* on the surface of the second sliding part 136*e*. Thus, the abrasion amount of the zinc phosphate film 136*f* is likely to be greater than that of the zinc phosphate film 136*g*. The inventors carried out abrasion resistance tests in regard to this point, and confirmed that zinc phosphate films 136*f* and 136*g* each having an initial thickness of 1 to 6 μm would not disappear by the end of the service life of the variable displacement compressor 100. That is, the inventors confirmed that the zinc phosphate films 136*f* and 136*g* had sufficient abrasion resistance.

(2) Test 2 (Changes in Surface Roughness of Zinc Phosphate Films 136*f* and 136*g*)

A test was carried out to observe how the surface roughness Ra of the zinc phosphate films 136*f* and 136*g* changes by coming into sliding contact with the spherical parts 137*c* of the pair of shoes (the first shoe 137*a* and the second shoe 137*b*). Specifically, changes in the surface roughness Ra of the zinc phosphate films 136*f* and 136*g* were observed in the following operation: a new piston 136 with zinc phosphate films 136*f* and 136*g* formed thereon is installed in the variable displacement compressor 100; the crank chamber 140 was brought to negative pressure and the upper surface (top surface) of the piston 136 was brought to atmospheric pressure, maximizing the inclination angle (maximum inclination angle) of the swash plate 111, so that a load was applied to the zinc phosphate film 136*f* on the first sliding part 136*d*; and then the drive shaft 110 is manually rotated. Sliding contact portions among the piston 136, the pair of shoes (the first shoe 137*a* and the second shoe 137*b*), and the swash plate 111 were coated with oil. The samples (new pistons 136) were chosen to have variations in initial surface roughness Ra of the zinc phosphate films 136*f* and 136*g*. The results of Test 2 are shown in FIG. 5.

Figure 5:
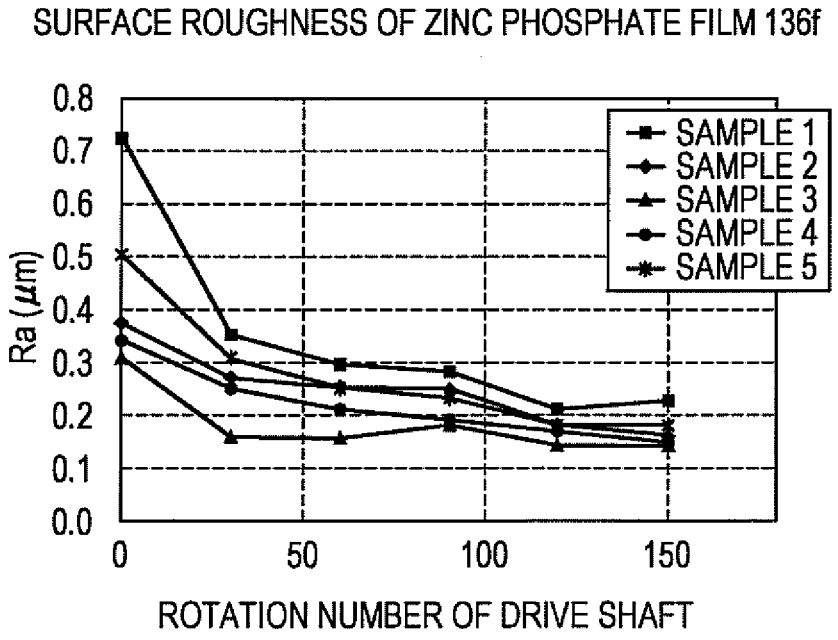
FIG. 5 is a chart showing results of Test 2 (changes in surface toughness of zinc phosphate films).

As shown in FIG. 5, as the number of rotation of the drive shaft 110 increased, the surface roughness Ra of the zinc phosphate film 136*f* was reduced and at the same time, variations in surface roughness Ra among the pistons 136 were reduced. It was observed that the surface roughness Ra of the zinc phosphate film 136*f* finally converged to less than 0.3 (more specifically, about 0.1 to 0.25).

This indicates that by installing new pistons 136 into the variable displacement compressor 100 and rotating the drive shaft 110, in other words, by operating the variable displacement compressor 100 for a short time (running-in operation), the surface of the zinc phosphate film 136*f* comes into sliding contact with the spherical part 137*c* of the first shoe 137*a* to be gradually smoothened (to have a smooth surface condition), which imparts running-in ability to the surface of the zinc phosphate film 136*f* to reduce frictional resistance of the surface of the film 136*f* in sliding contact with the spherical part 137*c* of the first shoe 137*a*, that is, the surface of the zinc phosphate film 136*f* exhibits seizing resistance.

Although not shown in the figure, the surface roughness of the zinc phosphate film 136*g* on the second sliding part 136*e* hardly changed even when the number of rotation of the drive shaft 110 increased. Thus, by the running-in operation, the surface roughness of the zinc phosphate film 136*f* formed on the surface of the first sliding part 136*d* becomes less than that of the zinc phosphate film 136*g* formed on the surface of the second sliding part 136*e*.

(3) Test 3 (Galling Resistance of Zinc Phosphate Film 136*f* and Rotational Torque of Drive Shaft 110)

Figures 6, 7:
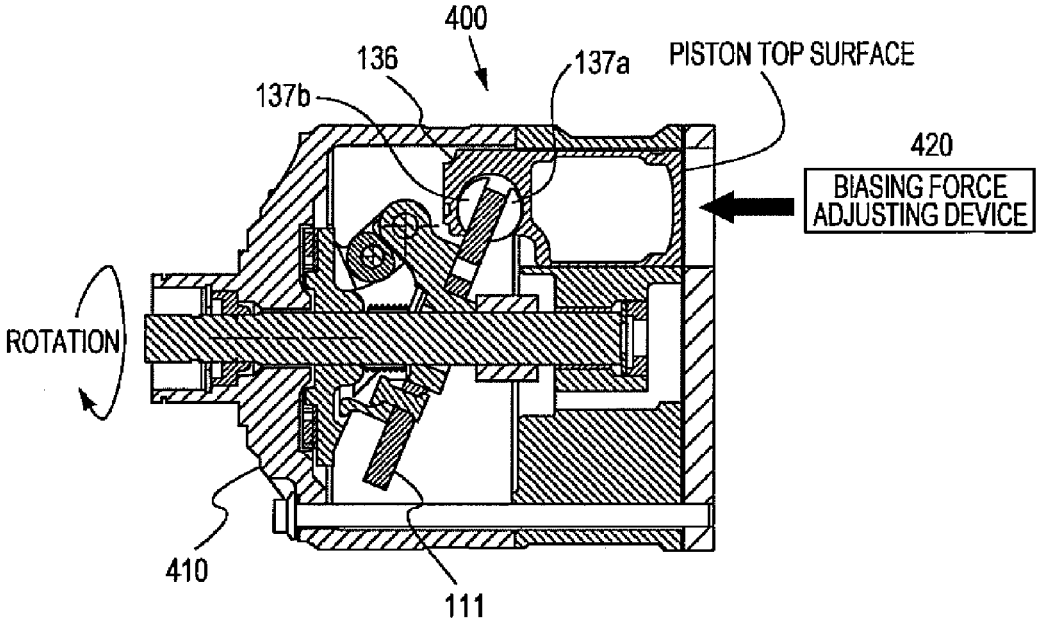
FIG. 6 is a view of an example of a testing device used in Test 3 (galling resistance of zinc phosphate film and rotational torque of drive shaft).
FIG. 7 is a table showing results of Test 3.

Next, similarly to Test 2, the piston 136 which was installed into the variable displacement compressor 100, in which the drive shaft 110 was manually rotated to reduce the surface roughness Ra of the zinc phosphate film 136*f*, that is, the piston 136 the surface of which was adjusted (smoothened) of the zinc phosphate film 136*f* on the first sliding part 136*d*, was tested to observe whether or not it actually exhibited running-In ability. Specifically, an excessive biasing force was applied to the upper surface (top surface) of the piston 136 with a testing device 400 as shown in FIG. 6 to observe whether or not galling occurred between the first sliding part 136*d* and the spherical part 137*c* of the first shoe 137*a*.

The testing device 400 is provided with a compressor main body 410 into which a piston 136 is set and a biasing force adjusting device 420 that applies a biasing force on an upper surface (top surface) of the piston 136 which has been set. The biasing force adjusting device 420 may have any configuration as long as it can apply a biasing force on the upper surface (top surface) of the piston 136 set in the compressor main body 410.

In the compressor main body 410 of the testing device 400, the inclination angle of a swash plate 111 is fixed at a maximum inclination angle. The biasing force adjusting device 420 applies a biasing force that is equal to a pressure of 10 MPa on the upper surface (top surface) of the piston 136 when the piston 136 is at the top dead center position, and the biasing force decreases to zero when the piston 136 moves a predetermined distance from the top dead center position toward the bottom dead center position. Here, the pressure of 10 MPa applied to the upper surface (top surface) of the piston 136 at the top dead center position simulates liquid compression and is higher than is possible in the normal operation of the variable displacement compressor 100 of the present embodiment.

The samples used were pistons of two types, pistons 136 after 20 manual rotations of the drive shaft 110 and pistons 136 after 80 manual rotations of the drive shaft 110, both of which have been prepared similarly to Test 2. The piston after 20 rotations of the drive shaft 110 simulates a condition in which running in (operation) is insufficient. The piston after 80 rotations of the drive shaft 110 simulates a condition in which running in (operation) is sufficient.

In Test 3, in the testing device 400 shown in FIG. 6, the drive shaft 110 was rotated while the biasing force adjusting device 420 was applying a predetermined biasing force on the upper surface (top surface) of the piston 136, to observe whether or not galling occurs between the first sliding part 136*d* and the spherical part 137*c* of the first shoe 137*a*, and the rotational torque of the drive shaft 110 of that time was measured.

The piston 136, the pair of shoes (the first shoe 137*a* and the second shoe 137*b*), and the swash plate 111 had been washed, with no oil adhering to them. Also, in this test, the drive shaft 110 was rotated 10 times to check whether or not galling occurs during the rotation.

The results of Test 3 are shown in FIG. 7.

The drive shaft 110 was able to be rotated 10 times without causing galling for all the pistons 136 (n=5) with which the drive shaft 110 was rotated 80 times in advance (i.e. with sufficient running-in). On the other hand, among the pistons 136 (n=5) with which the drive shaft 110 was rotated 20 times in advance (i.e., without sufficient running-in), the drive shaft 110 was able to be rotated 10 times for only one piston 136 (galling occurred at the rest of the pistons 136.

Figure 8:
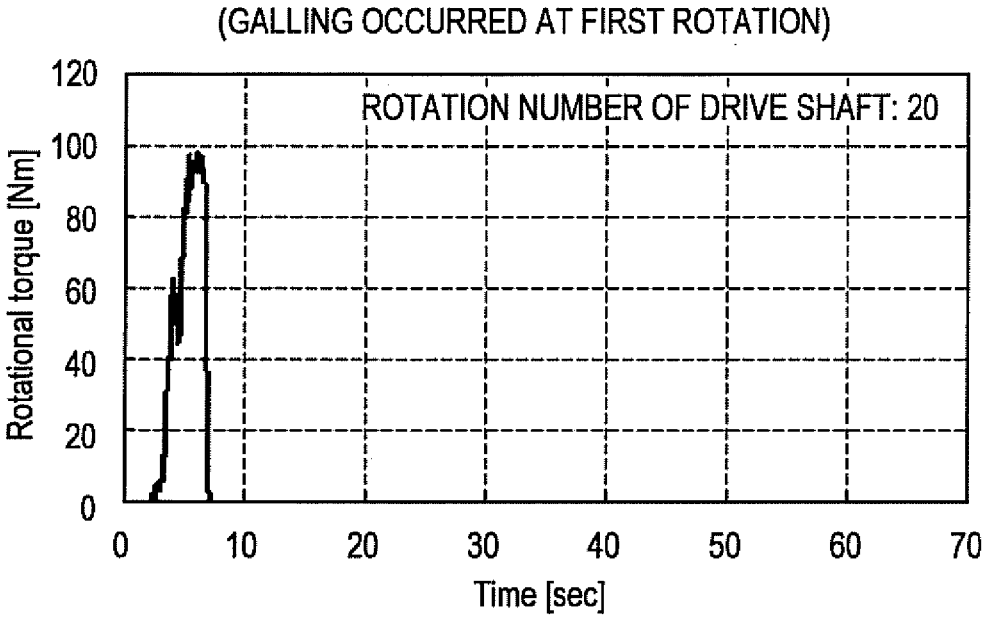
FIG. 8 is a chart of an example of data on drive shaft rotational torque in Test 3.
Figure 9:
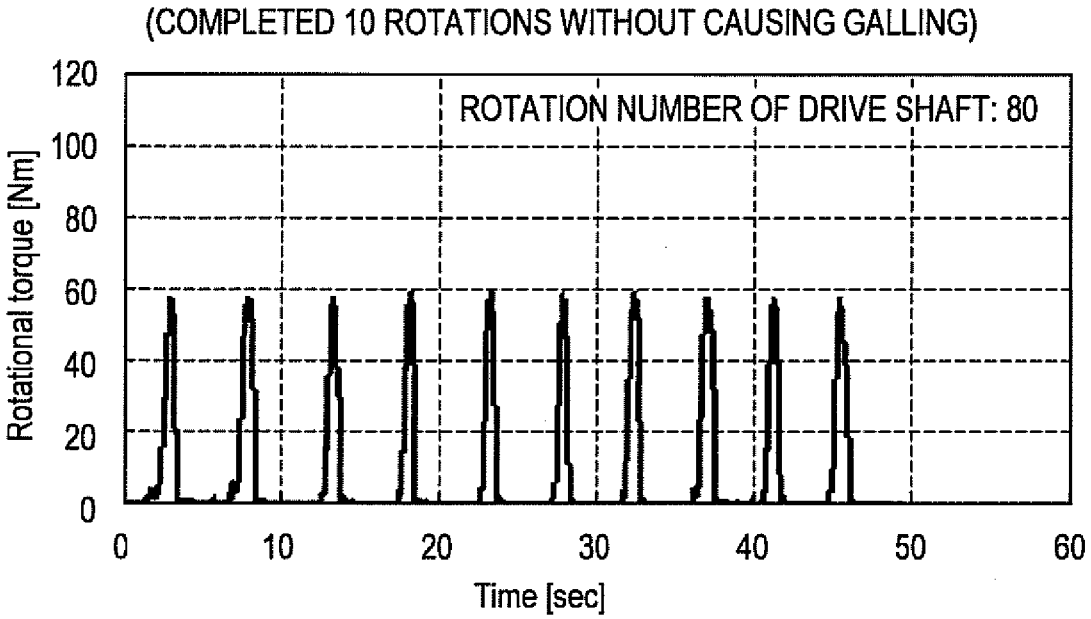
FIG. 9 is also a chart of an example of data on the drive shaft rotational torque in Test 3.

Each of FIGS. 8 and 9 is exemplary data of the rotational torque of the drive shaft 110. FIG. 8 indicates rotational torque data of the drive shaft 110 in which galling occurred at the first rotation. FIG. 9 indicates rotational torque data of the drive shaft 110 in which the drive shaft 110 was able to rotate 10 times without causing galling.

For pistons with no zinc phosphate films 136*f* and 136*g* formed on the first sliding part 136*d* and 136*e*, galling occurred on all of the pistons (100%) and the drive shaft 110 was not able to rotate 10 times with any of the pistons.

Thus, it was observed that a piston 136 with zinc phosphate films 136*f* and 136*g* formed on a first sliding part 136*d* and a second sliding part 136*e*, in particular, having a surface of the zinc phosphate film 136*f* on the first sliding part 136*d* sufficiently adjusted (smoothened) by sliding contact with a spherical part 137*c* of a first shoe 137*a* causes no galling on a part in sliding contact with the shoe even without any oil and even if an excessive compression load is applied, and that the zinc phosphate film 136*f* has a sufficient running-in ability. That is, the zinc phosphate film 136*f* is functioning as a "running-in layer".

From the results of Tests 1 to 3, it was observed that (a) the zinc phosphate films 136*f* and 136*g* each having a thickness of 1 to 6 μm and a surface roughness Ra of 0.8 had sufficient abrasion resistance, (b) the zinc phosphate film 136*f* with the surface adjusted (smoothened) by the spherical part 137*c* of the first shoe 137*a* had sufficient running-in ability, and exhibits seizing resistance and galling resistance, and (c) the surface roughness Ra of the zinc phosphate film 136*f* formed on the first sliding part 136*d* becomes less than that of the zinc phosphate film 136*q* formed on the second sliding part 136*e*.

Next, adjustment (smoothening) of the surface of the zinc phosphate film in an assembly process of the variable displacement compressor 100 will be described.

In the assembly process of the variable displacement compressor 100, as long as the compressor housing has been formed by tightening a plurality of through bolts 105, the drive shaft 110 can be rotated to cause the piston 136 to reciprocate. Therefore, a process of rotating the drive shaft 110 for adjusting (smoothening) the surface of the zinc phosphate film, more specifically, an adjustment process of imparting running-in ability to the surface of the zinc phosphate film 136*f* on the first sliding part 136*d* may be provided after the process of forming the compressor housing. In the adjustment process, various conditions are set in advance so that the rotation of the drive shaft 110 ensures a desired running-in ability of the zinc phosphate film 136*h*. When the assembly process of the variable displacement compressor 100 includes a process of rotating the drive shaft 110, the assembly process can be partially or entirely used as the adjustment process.

Here, in the adjustment process, as described above, the surface of the zinc phosphate film 136*f* on the first sliding part 136*d* is adjusted (smoothened) to have the surface roughness Ra reduced, whereas the surface roughness Ra of the zinc phosphate film 136*g* on the second sliding part 136*e* hardly changes. Accordingly, the surface of the zinc phosphate film 136*f* on the first sliding part 136*d* is smoothened and the surface roughness Ra of the zinc phosphate film 136*f* on the first sliding part 136*d* is less than that of the zinc phosphate film 136*g* on the second sliding part 136*e* when the variable displacement compressor 100 is in a finished product state, more specifically, before the shipment of the variable displacement compressor 100 from the factory.

Next, the effects of the variable displacement compressor 100 with the above configuration will be described.

When for example, a vehicle is left for a long time and the rotation of a variable displacement compressor stops for a long time, and thus a large amount of liquid refrigerant is stored inside the variable displacement compressor, the liquid refrigerant washes off oil inside the variable displacement compressor. After that, when the variable displacement compressor is started up, the oil flows to the outside of the compressor with the liquid refrigerant, making the inside of the variable displacement compressor temporarily unlubricated in some cases. That is, the temporary unlubricated state inside the variable displacement compressor tends to occur when the variable displacement compressor is started up.

In the variable displacement compressor 100 according to the embodiment, the zinc phosphate films 136*f* and 136*g* are formed on the first sliding part 136*d* and the second sliding part 136*e* of the piston 136 in sliding contact with the first shoe 137*a* and the second shoe 137*b*. In particular, the surface of the zinc phosphate film 136*f* on the first sliding part 136*d* has running-in ability as being smoothened in advance by the sliding contact with the spherical part 137*c* of the first shoe 137*a*. Therefore, even if sliding contact portions between the piston 136 and the shoes 137*a* and 137*b* come into an unlubricated state, galling or seizing at the sliding contact portions is suppressed.

In particular, in the present embodiment, as described above, when the variable displacement compressor 100 is stopped, the swash plate 111 is held at an inclination angle at which the biasing force of the inclination angle reducing spring 114 and the biasing force of the inclination angle increasing spring 115 are balanced. The inclination angle at this point is set as the minimum inclination angle range (e.g. 1° to 3°) which reliably ensures the compression operation of the piston 136. This structurally avoids a situation in which a large force acts on the first sliding part 136*d* when the variable displacement compressor 100 starts up. In addition, because of the effect of running-in ability of the zinc phosphate film (particularly, the zinc phosphate film 136*f* of the first sliding part 136*d*), the reliable operation of the variable displacement compressor 100 is ensured during the temporary unlubricated state while oil circulates in the air conditioning system and returns to the variable displacement compressor 100.

Although the present invention is applied to a variable displacement compressor in which the inclination angle of a swash plate (piston stroke) can be changed in the above embodiment, needless to say, the present invention can also be applied to a fixed displacement compressor in which the inclination angle of a swash plate is fixed.

In the above embodiment, the assembly process of the variable displacement compressor 100 includes the adjustment process of imparting running-in ability to the surface of the zinc phosphate film 136*f* on the first sliding part 136*d*, and thus, the surface roughness Ra of the zinc phosphate film 136*f* on the first sliding part 136*d* becomes less than that of the zinc phosphate film 136*g* on the second sliding part 136*e* before the shipment of the variable displacement compressor 100 from the factory. However, the present invention is not limited thereto, and the assembly process of the variable displacement compressor 100 does not have to include the adjustment process. This is because oil is enclosed in a finished variable displacement compressor 100, so that when the variable displacement compressor 100 is mounted in a vehicle and initially operated, the inside of the compressor will not enter into the unlubricated state.

In this case, the initial operation ensures running-in ability on the surface of the zinc phosphate film 136*f* on the first sliding part 136*d*, and then the surface roughness Ra of the zinc phosphate film 136*f* on the first sliding part 136*d* becomes less than that of the zinc phosphate film 136*g* on the second sliding part 136*e*. That is, the initial operation corresponds to the running-in operation. The present invention includes a case in which the surface roughness Ra of the zinc phosphate film 136*f* on the first sliding part 136*d* becomes less than that of the zinc phosphate film 136*g* on the second sliding part 136*e* after the initial operation.

Furthermore, when a zinc phosphate film is interposed between a concave spherical sliding part of a piston and a spherical part of a shoe, it is also assumed that the zinc phosphate film is formed on the surface of the spherical part of the shoe, rather than on the surface of the concave spherical sliding part of the piston. However, to ensure running-in ability of the zinc phosphate film, the zinc phosphate film is preferably formed on the surface of the concave spherical sliding part of the piston. This is because, in general, a spherical part of a shoe is hard, has a precisely controlled surface roughness, and has a convex surface, which is suitable for fitting a zinc phosphate film formed in a concave spherical shape.

REFERENCE SYMBOL LIST

100 Variable displacement compressor (Swash plate compressor)
101 Cylinder block
101*a* Cylinder bore
102 Front housing
104 Cylinder head
110 Drive shaft

111 Swash plate
111*c*, 111*d* Flat sliding part
112 Rotor
120 Link mechanism
136 Piston
136*a* Piston main body
136*b* Extending part
136*c* Accommodating part
136*d* First sliding part (Concave spherical sliding part)
136*e* Second sliding part (Concave spherical sliding part)
136*f*, 136*g* Zinc phosphate film
137*a* First shoe
137*b* Second shoe
137*c* Spherical part
137*d* Flat part
141 Suction chamber
142 Discharge chamber

The invention claimed is:

1. A swash plate compressor comprising:

a swash plate that rotates with a drive shaft;

a pair of shoes placed to sandwich a portion of the swash plate close to a periphery of the swash plate; and a piston connected to the swash plate via the pair of shoes, the piston being caused to reciprocate by rotation of the swash plate, wherein a zinc phosphate film is formed on surfaces of each sliding part of the piston at which each of the pair of shoes is in sliding contact.

2. The swash plate compressor according to claim 1, wherein the piston includes: a piston main body; and an extending part extending from the piston main body and including an accommodating part capable of accommodating the pair of shoes, wherein each of the pair of shoes includes: a spherical part in sliding contact with a concave spherical sliding part formed in the accommodating part; and a flat part in sliding contact with a flat sliding part of the swash plate, wherein the pair of shoes is a first shoe placed in the accommodating part on a piston main body side of the swash plate, and a second shoe placed in the accommodating part on an opposite side of the swash plate opposite to the piston main body, wherein the concave spherical sliding parts are a first sliding part in sliding contact with the spherical part of the first shoe, and a second sliding part in sliding contact with the spherical part of the second shoe, and wherein a surface roughness of the zinc phosphate film formed on the first sliding part is less than a surface roughness of the zinc phosphate film formed on the second sliding part.

3. The swash plate compressor according to claim 2, wherein a surface of the zinc phosphate film formed on the first sliding part is smoothened in advance by the sliding contact with the spherical part of the first shoe before shipment from a factory.

4. The swash plate compressor according to claim 3, wherein the zinc phosphate film has a thickness of 1 to 6 μm and a surface roughness Ra of 0.8 or less.

5. The swash plate compressor according to claim 2, wherein the zinc phosphate film has a thickness of 1 to 6 μm and a surface roughness Ra of 0.8 or less.

6. The swash plate compressor according to claim 1, wherein the zinc phosphate film has a thickness of 1 to 6 μm and a surface roughness Ra of 0.8 or less.

* * * * *